US009636265B2

(12) United States Patent
Furuta et al.

(10) Patent No.: US 9,636,265 B2
(45) Date of Patent: May 2, 2017

(54) PASSENGER CARRYING MOBILE ROBOT

(71) Applicants: Chiba Institute of Technology, Narashino-shi, Chiba (JP); Aisin Seiki Kabushiki Kaisha, Kariya-shi, Aichi (JP)

(72) Inventors: Takayuki Furuta, Narashino (JP); Masaharu Shimizu, Narashino (JP); Hideaki Yamato, Narashino (JP); Kengo Toda, Narashino (JP); Takashi Kodachi, Narashino (JP); Mitsuhiro Ando, Kariya (JP); Noboru Nagamine, Kariya (JP); Seongjun Yang, Kariya (JP); Hirotoshi Ochiai, Kariya (JP); Wataru Takayanagi, Kariya (JP)

(73) Assignees: Chiba Institute Of Technology, Chiba (JP); Aisin Seiki Kabushiki Kaisha, Aichi (JP)

( * ) Notice: Subject to any disclaimer, the term of this patent is extended or adjusted under 35 U.S.C. 154(b) by 77 days.

(21) Appl. No.: 14/635,674

(22) Filed: Mar. 2, 2015

(65) Prior Publication Data

US 2015/0245962 A1 Sep. 3, 2015

(30) Foreign Application Priority Data

Mar. 3, 2014 (JP) ..... 2014-040515

(51) Int. Cl.
*A61G 5/04* (2013.01)
*A61G 5/06* (2006.01)

(52) U.S. Cl.
CPC ..... *A61G 5/04* (2013.01); *A61G 5/06* (2013.01); *A61G 2203/72* (2013.01); *Y10S 901/01* (2013.01)

(58) Field of Classification Search
CPC . A61G 5/04; A61G 2203/72; A61G 2203/726
See application file for complete search history.

(56) References Cited

U.S. PATENT DOCUMENTS 5,497,056 A * 3/1996 Kurland ..... B60L 7/16 180/907
2006/0247847 A1* 11/2006 Carter ..... A47F 10/04 701/498

(Continued)

FOREIGN PATENT DOCUMENTS

JP 2003-220096 A 8/2003

OTHER PUBLICATIONS

Mattern et al., "An Automotive Perception System using Distance Cameras and Polar Occupancy Grids" (hereinafter Mattern).*

*Primary Examiner* — Adam Mott
(74) *Attorney, Agent, or Firm* — Harness, Dickey & Pierce, P.L.C.

(57) ABSTRACT

A single passenger carrying mobile robot, includes a single operated member that is operated by a passenger to instruct both a moving direction and a moving speed of the passenger carrying mobile robot, a moving member configured to move the passenger carrying mobile robot and a controller configured to control the moving member based on input information input to the operated member by the passenger, wherein the passenger carrying mobile robot further includes a sensor that acquires obstacle information of a surrounding of the passenger carrying mobile robot, and the controller predicts an expected course of the passenger carrying mobile robot based on the input information and determines based on the obstacle information whether or not an obstacle is located in the expected course, and changes a control of the moving member when determining that the obstacle is located.

16 Claims, 14 Drawing Sheets

(56) References Cited

U.S. PATENT DOCUMENTS

| | | | | |
|---|---|---|---|---|
| 2006/0293855 | A1* | 12/2006 | Hammarlund | G01S 5/0072 701/301 |
| 2009/0055020 | A1* | 2/2009 | Jeong | G05D 1/0246 700/251 |
| 2015/0025660 | A1* | 1/2015 | Prassler | A63B 21/0615 700/91 |

* cited by examiner

| LOCATION OF GRID IN RADIAL DIRECTION (r COORDINATE) | NUMBER OF GRIDS INCLUDING TRACE (X) | NUMBER OF GRIDS ON TWO SIDES (Y) | NUMBER OF GRIDS ARRANGED IN CIRCUMFERENTIAL DIRECTION(X+Y) |
|---|---|---|---|
| $r < N$ | 1 | 2 | 3 |
| $r \geqq N$ | 1 | 4 | 5 |

FIG. 8

| LOCATION OF GRID IN RADIAL DIRECTION (r COORDINATE) | NUMBER OF GRIDS INCLUDING TRACE (X) | NUMBER OF GRIDS ON TWO SIDES (Y) | NUMBER OF GRIDS ARRANGED IN CIRCUMFERENTIAL DIRECTION(X+Y) |
|---|---|---|---|
| $r < N$ | 1 | 0 | 1 |
| $r \geqq N$ | 1 | 2 | 3 |

FIG. 9

| LOCATION OF GRID IN RADIAL DIRECTION (r COORDINATE) | NUMBER OF GRIDS INCLUDING TRACE (X) | NUMBER OF GRIDS ON TWO SIDES (Y) | NUMBER OF GRIDS ARRANGED IN CIRCUMFERENTIAL DIRECTION(X+Y) |
|---|---|---|---|
| $r < N$ | 1 | 8 | 9 |
| $r \geqq N$ | 1 | 2 | 3 |

FIG. 10

| LOCATION OF GRID IN RADIAL DIRECTION (r COORDINATE) | NUMBER OF GRIDS INCLUDING TRACE (X) | NUMBER OF GRIDS ON TWO SIDES (Y) | NUMBER OF GRIDS ARRANGED IN CIRCUMFERENTIAL DIRECTION(X+Y) |
|---|---|---|---|
| $r < N$ | 1 | 6 | 7 |
| $r \geqq N$ | 1 | 0 | 1 |

FIG. 11

| LENGTH l OF ASSUMED MOVEMENT TRACE | NUMBER OF GRIDS INCLUDING TRACE (X) | NUMBER OF GRIDS ON TWO SIDES (Y) | NUMBER OF GRIDS ARRANGED IN CIRCUMFERENTIAL DIRECTION(X+Y) |
|---|---|---|---|
| $l < L$ | 1 | 4 | 5 |
| $l \geqq L$ | 1 | 2 | 3 |

FIG. 12

| LOCATION OF GRID IN RADIAL DIRECTION (r COORDINATE) | THRESHOLD VALUE USED TO DETERMINE OBSTACLE GRID |
|---|---|
| $r < N$ | 10 |
| $r \geqq N$ | 5 |

| POINT HEIGHT | WEIGHTING NUMBER |
|---|---|
| $h < N$ | 1 |
| $h \geqq N$ | 0.5 |

PASSENGER CARRYING MOBILE ROBOT

CROSS-REFERENCE TO RELATED APPLICATION

The present application claims the benefit of priority pursuant to 35 U.S.C. §119(a) to Japanese Patent Application No. 2014-40515, filed on Mar. 3, 2014, the entire disclosure of which is hereby incorporated herein by reference.

BACKGROUND

Technical Field

Embodiments of the present invention generally relate to a passenger carrying mobile robot.

Related Art

A single passenger carrying mobile robot is already well known. A wheelchair can be given as an example of this passenger carrying mobile robot.

The passenger carrying mobile robot such as that above includes a single operated member that is operated by the passenger for instructing both the moving direction and the moving speed of the passenger carrying mobile robot, a moving member for moving the passenger carrying mobile robot, and a controller that controls the moving member based on the input information input to the operated member by the passenger. (JP-2003-220096-A).

In such a passenger carrying mobile robot, the operation is left to the passenger. Thus, in a circumstance where the safety of the passenger is lost due to the operation of the passenger, there is a need to reduce the passenger's risk.

The present invention has been made in view of the above conventional problem and it is therefore an objective of the present invention to realize a passenger carrying mobile robot that can reduce the passenger's risk.

SUMMARY

Disclosed embodiments describe a single passenger carrying mobile robot, including a single operated member that is operated by a passenger to instruct both a moving direction and a moving speed of the passenger carrying mobile robot, a moving member configured to move the passenger carrying mobile robot, and a controller that is configured to control the moving member based on input information input to the operated member by the passenger, wherein the passenger carrying mobile robot further includes a sensor that acquires obstacle information of a surrounding of the passenger carrying mobile robot, and the controller predicts an expected course of the passenger carrying mobile robot based on the input information and determines based on the obstacle information whether or not an obstacle is located in the expected course, and changes a control of the moving member when determining that the obstacle is located.

Other characteristics of the present invention will become clear from the description in the detailed description of the invention and the drawings attached.

BRIEF DESCRIPTION OF THE DRAWINGS

For a more complete understanding of the present invention and the advantages thereof, reference is now made to the following description taken in conjunction with the accompanying drawings wherein:

FIG. 8 is a table illustrating a grid configuration of an expected course according to a first modified example;

FIG. 9 is a table illustrating a grid configuration of an expected course according to a second modified example;

FIG. 10 is a table illustrating a grid configuration of an expected course according to a third modified example;

FIG. 11 is a table illustrating a grid configuration of an expected course according to a fourth modified example;

FIG. 12 is a table illustrating a grid configuration of an expected course according to fifth and sixth modified examples;

DETAILED DESCRIPTION

Figure 1:
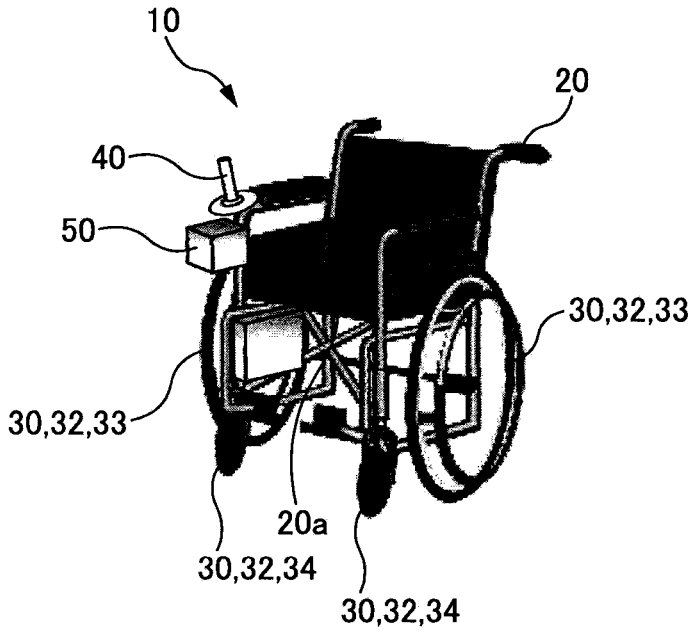
FIG. 1 is a schematic diagram illustrating an external configuration of the wheelchair 10 of one embodiment of the present invention.

At least the following matters will become clear from the description in the present specification and the attached drawings.

A single passenger carrying mobile robot, comprising a single operated member that is operated by a passenger to instruct both a moving direction and a moving speed of the passenger carrying mobile robot, a moving member configured to move the passenger carrying mobile robot, and a controller that is configured to control the moving member based on input information input to the operated member by the passenger, wherein the passenger carrying mobile robot further includes a sensor that acquires obstacle information of a surrounding of the passenger carrying mobile robot, and the controller predicts an expected course of the passenger carrying mobile robot based on the input information and determines based on the obstacle information whether or not an obstacle is located in the expected course, and changes a control of the moving member when determining that the obstacle is located.

According to the above case, a passenger carrying mobile robot that can reduce the passenger's risk can be realized.

Further, the controller may be made to predict the expected course in grid units of two dimensional polar coordinates with the passenger carrying mobile robot at a center and specifies in the grid units whether or not the obstacle is located.

According to the above case, an appropriate determination method in accordance with the distance from the passenger carrying mobile robot can be realized.

Furthermore, the controller may be made to perform the control such that at least one of the moving speed and an acceleration of the passenger carrying mobile robot does not exceed a predetermined value when determining that the obstacle is located.

According to the above case, collision at a high moving speed or at a highly accelerated state is avoided even if the passenger carrying mobile robot were to collide with an obstacle so that the passenger's risk is appropriately reduced.

Yet further still, the controller may be made to specify based on the obstacle information a shortest distance to the obstacle located in the expected course and change the predetermined value according to the shortest distance.

According to the above case, the appropriate speed and acceleration limit values can be set in accordance with the danger level so that the passenger's risk can be effectively reduced.

Even further still, the controller may be made to respectively specify based on the obstacle information the shortest distance to the obstacle located in the expected course at two time points that are different from each other and change the predetermined value according to a speed obtained based on two of the shortest distances.

According to the above case, the appropriate speed and acceleration limit values can be set in accordance with the danger level so that the passenger's risk can be effectively reduced.

Even further still, the controller may be made to respectively specify based on the obstacle information the shortest distance to the obstacle located in the expected course at three time points that are different from each other and change the predetermined value according to an acceleration obtained based on three of the shortest distances.

According to the above case, the appropriate speed and acceleration limit values can be set in accordance with the danger level so that the passenger's risk can be effectively reduced.

Even further still, the controller may be made to respectively specify based on the respective obstacle information the shortest distance to the obstacle located in the expected course at two or three time points that are different from each other and change the predetermined value according to a weighting function that has respectively weighted at least two variables among one of the shortest distance, a speed obtained based on two of the shortest distances, and an acceleration obtained based on three of the shortest distances.

According to the above case, the appropriate speed and acceleration limit values can be set in accordance with the danger level so that the passenger's risk can be effectively reduced.

Even further still, the controller when determining that the obstacle is located, may be made to perform a speed and/or acceleration limiting process that performs the control such that at least one of the moving speed and the acceleration of the passenger carrying mobile robot does not exceed a predetermined value and cancel the speed and/or acceleration limiting process after maintaining the speed and/or acceleration limiting process for a predetermined time, when determining that the obstacle is not located during the speed and/or acceleration limiting process.

According to the above case, the speed and acceleration limits can be canceled after confirming that safety has been secured due to enough passage of time.

Even further still, the controller may be made to increase the predetermined value when the speed and/or acceleration limiting process is maintained for the predetermined time.

According to the above case, the speed and acceleration limits can be reduced along with the increased possibility on the confirmation of safety.

Even further still, the controller may be made to obtain a linear assumed movement trace, from when the input information is input until a predetermined time has passed, based on the input information, and set, as the expected course, all trace including grids in which the assumed movement trace is included and two side grids, positioned on both sides in a circumferential direction, of the trace including grids.

According to the above case, determination can be made on whether or not there is an obstacle located in the expected course, taking into consideration the width of the passenger carrying mobile robot.

Even further still, the controller may be made to change a number of grids of the two side grids according to a length of the assumed movement trace.

According to the above case, an expected course can be set taking into consideration the appropriateness of the turning ability of the passenger carrying mobile robot.

Even further still, the sensor is a first sensor, and the passenger carrying mobile robot includes a second sensor different from the first sensor, and the controller may be made to be capable of acquiring an actual moving speed of the passenger carrying mobile robot from the second sensor, reset the assumed movement trace based on the actual movement speed acquired, and changes the number of grids of the two sides grids according to the length of the reset assumed movement trace.

According to the above case, an expected course appropriately taking into consideration the actual moving speed can be set.

Even further still, the controller may be made to set, as the expected course, all the trace including grids in which the assumed movement trace is included and the two side grids positioned on the both sides in the circumferential direction of all the trace including grids, and the number of grids of the two side grids may be a same for all of the trace including grids.

According to the above case, the passenger's risk can be appropriately reduced even when the obstacle detection accuracy of the sensor decreases at a location far from the passenger carrying mobile robot.

Even further still, the expected course may be set such that a number of grids of a first two side grids positioned on the both sides in the circumferential direction of a first trace including grid is less than a number of grids of a second two side grids positioned on the both sides in the circumferential direction, of a second trace including grid positioned at a location farther in a radial direction than the first trace including grid when seen from the passenger carrying mobile robot.

According to the above case, the passenger's risk can be appropriately reduced even when the obstacle detection accuracy of the sensor further decreases at a location far from the passenger carrying mobile robot.

Even further still, the expected course may be set such that a number of grids of a first two side grids positioned on the both sides in the circumferential direction of a first trace including grid is greater than a number of grids of a second two side grids positioned on the both sides in the circumferential direction, of a second trace including grid positioned at a location farther in a radial direction than the first trace including grid when seen from the passenger carrying mobile robot.

According to the above case, the passenger's risk can be appropriately reduced even when there is an obstacle at a location proximate the passenger carrying mobile robot.

Even further still, the controller may be made to receive from the sensor the obstacle information as a group of points having three dimensional location information, set a grid as the grid in which the obstacle is positioned when the group of points is projected on the two dimensional polar coordinates and a number of the group of points included in the grid exceeds a threshold value, and the threshold value is changed according to a location in a radial direction of the grid.

According to the above case, the passenger's risk can be appropriately reduced even when the obstacle detection accuracy of the sensor decreases at a location far from the passenger carrying mobile robot.

Even further still, the controller may be made to receive from the sensor the obstacle information as a group of points having three dimensional location information, set, to each point of the group of points, a weighting value according to a location in a height direction of the point, and set a grid as the grid in which the obstacle is positioned when the group of points is projected on the two dimensional polar coordinates and a total of the weighting values of the group of points included in the grid exceeds a threshold value.

According to the above case, a more appropriate determination relating to obstacles can be made by taking into consideration the significance (weight) of each point in the group of points.

Even further still, a display part that displays the expected course and the obstacle located in the expected course may be included.

According to the above case, the passenger's risk can be furthermore reduced since the passenger can appropriately recognize the expected course and the obstacle located in the expected course.

Even further still, a notifying part that notifies that the control has changed may be included.

According to the above case, the passenger's risk can be furthermore reduced since attention is drawn from the passenger.

Even further still, the passenger carrying mobile robot may be a wheelchair.

According to the above case, a wheelchair that can reduce the passenger's risk can be realized.

===Configuration Example of the Wheelchair 10===

One configuration example of the wheelchair 10 according to the present embodiment is described in detail below with reference to FIGS. 1 to 4.

Figure 2:
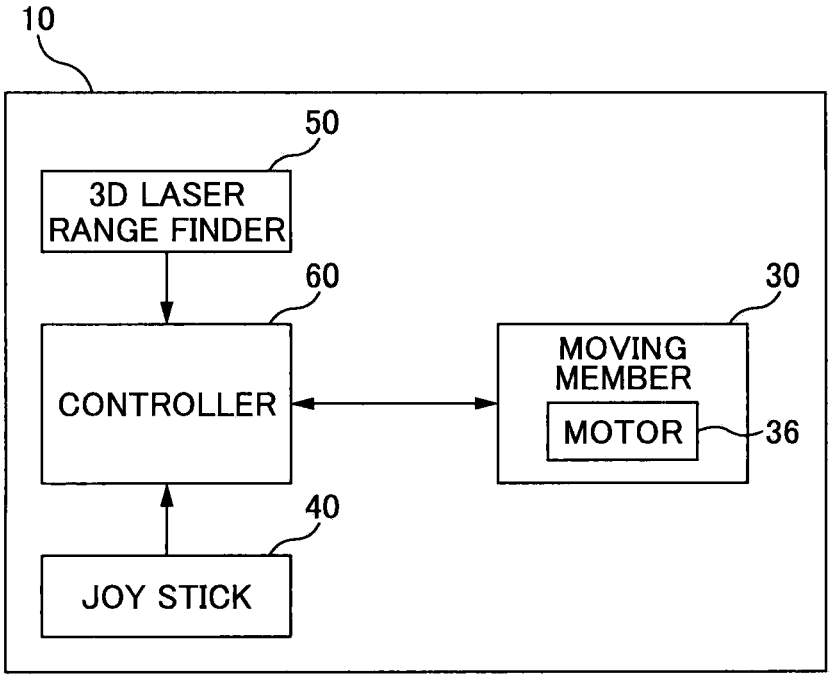
FIG. 2 is a block diagram illustrating an internal configuration of the wheelchair 10.

FIG. 1 is a schematic diagram illustrating an external configuration of the wheelchair 10. FIG. 2 is a block diagram illustrating an internal configuration of the wheelchair 10. The description of FIGS. 3 and 4 will be given later.

The electric wheelchair (simply called wheelchair 10) as an example of a single passenger carrying mobile robot for carrying a single person includes a vehicle body 20, moving members 30, a joy stick 40 as an example of an operated member, a 3D laser range finder 50 (laser sensor) as an example of a sensor (first sensor), and a controller 60.

The vehicle body 20 is the body of the wheelchair 10 and has a seat 20*a* and the like. Further, the vehicle body 20 has mounted thereto moving members 30, a joy stick 40, a 3D laser range finder 50, a controller 60 and the like.

The moving members 30 are for allowing the wheelchair 10 to move. And the moving members 30 are equipped with wheels 32 and motors 36.

The wheels 32 are configured so to be rotatable around the rotating shaft and the wheelchair 10 moves (travels) along with the rotation of the wheels 32. The wheelchair 10 according to the present embodiment is equipped with two (right and left) drive wheels 33 and two (right and left) non-driven wheels 34 having diameters smaller than those of the drive wheels 33.

The motor 36 is for rotating the wheels 32 (specifically, drive wheels 33). Note that, the motors 36 (a total of two) are provided one for each of the two (right and left) drive wheels 33.

The joy stick 40 is a single member that is operated by the passenger for instructing both the moving direction and the moving speed of the wheelchair 10.

The joy stick 40 is in a state standing parallel to the z direction (the direction penetrating the plane of the paper in FIG. 3) when in an un-operated state. In other words, the position of the joy stick 40 coincides with the z axis. Note that the z axis direction is substantially parallel to the vertical direction with regard to the wheelchair 10.

Figure 3:
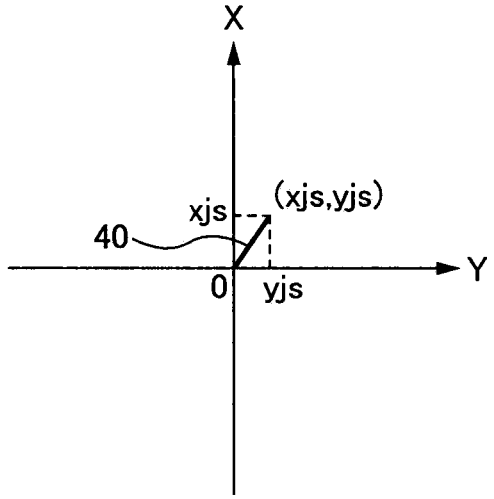
FIG. 3 is a schematic diagram illustrating the appearance of the inclined joy stick 40 projected on an xy plane.

When the passenger operates (specifically, tilts) the joy stick 40, the joy stick 40 is inclined as shown in FIG. 3. Here, FIG. 3 is a schematic diagram illustrating the appearance of the inclined joy stick 40 projected on the xy plane. The joy stick 40 according to the present embodiment outputs the coordinates (xjs, yjs) shown in FIG. 3 as the input information input to the joy stick 40. In other words, the input information according to the present embodiment are the values of the x and y coordinates of the tip of the joy stick 40, and these are the values that are to be output.

The 3D laser range finder 50 is for acquiring obstacle information around the wheelchair 10. This 3D laser range finder 50 will be described later in detail.

The controller 60 is for controlling the moving members 30 based on the input information input to the joy stick 40 by the passenger.

Figure 4:
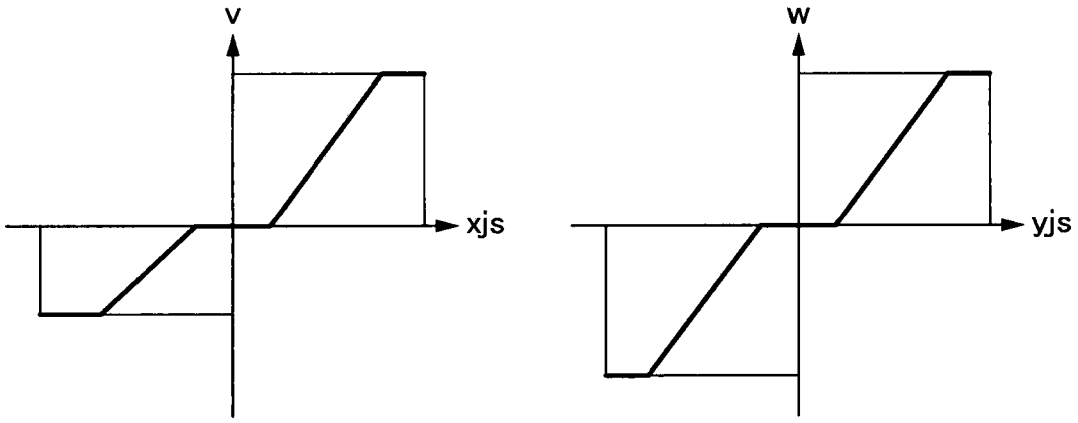
FIG. 4 is a schematic diagram illustrating a conversion rule for converting (xjs, yjs) to (v, w)

In other words, the controller 60 according to the present embodiment receives the aforementioned xjs and yjs and respectively converts the xjs and yjs into the instructed straight advancing speed v (that is, the speed in the direction in which the wheelchair 10 is facing, in other words the speed toward the front direction) and the instructed turning speed w (the angular speed of rotation (circulation) with the direction normal to the ground surface (out-of-plane direction) as the center), respectively based on the conversion rule illustrated in FIG. 4.

FIG. 4 is a schematic diagram illustrating a conversion rule for converting (xjs, yjs) into (v, w). As illustrated in FIG. 4, xjs is converted in proportion to the instructed straight advancing speed v, except at three dead zones (the dead zones are parts where the v does not change even though xjs changes). Note that, the present embodiment assumes a proportional (linear) conversion, however, it is not limited to such and can be a non-linear conversion. Similarly, yjs is converted in proportion to the instructed turning speed w, except at three dead zones (the dead zones are parts where the w does not change even though yjs changes). Note that, the present embodiment assumes a proportional (linear) conversion, however, it is not limited to such and can be a non-linear conversion.

Next, the controller 60 controls the aforementioned moving members 30 so that the straight advancing speed of the wheelchair 10 becomes the instructed straight advancing speed v converted from xjs, and the turning speed of the wheelchair 10 becomes the instructed turning speed w converted form yjs as well. Specifically, at first, the set of the instructed straight advancing speed v and the instructed turning speed w are converted to a set of the left drive wheel rotating speed lv of the left side drive wheel 33 and the right drive wheel rotating speed ry of the right side drive wheel 33 by a well known method. In other words, the speed in which the left and right drive wheels 33 are to be rotated for realizing the instructed straight advancing speed v and the instructed turning speed w is calculated. Note that, the turning of the wheelchair 10 according to this embodiment is realized by providing a difference in the speed of the right and left drive wheels 33. And there is a need to increase the difference in the rotation speed between the left and right drive wheels 33 along with the increase in the instructed turning speed w.

And the controller 60 gives an instruction (that is, controls the current and voltage of the motor 36) to the motor 36 such that the left side drive wheel 33 (right side drive wheel 33) agrees with the left drive wheel rotating speed lv (right side drive wheel rotating speed rv).

Note that, the feedback control may be performed by monitoring the current (voltage) values of the motors 36 and the rotating speeds of the drive wheels 33, and obtaining the differences between the instructed values of the current (voltage) and/or the drive wheel rotating speed for the differences to be fed back.

===Risk Reduction Control===

As described above, the operation of such a wheelchair 10 is left to the passenger. Therefore, the passenger's risk needs to be reduced in a circumstance where the safety of the passenger is interrupted by the operation by the passenger.

And control for reducing the risk (called risk reducing control) is performed in response to the above needs in the wheelchair 10 according to the present embodiment. Such a risk reducing control is realized mainly by the controller 60, specifically, by the controller 60 predicting the expected course along which the wheelchair 10 moves based on the aforementioned input information, determining whether or not an obstacle is located in the expected course based on the obstacle information acquired by the 3D laser range finder 50, and changing the control (changing to the safe side) of the moving members 30 when determining that there is an obstacle located.

Figure 5:
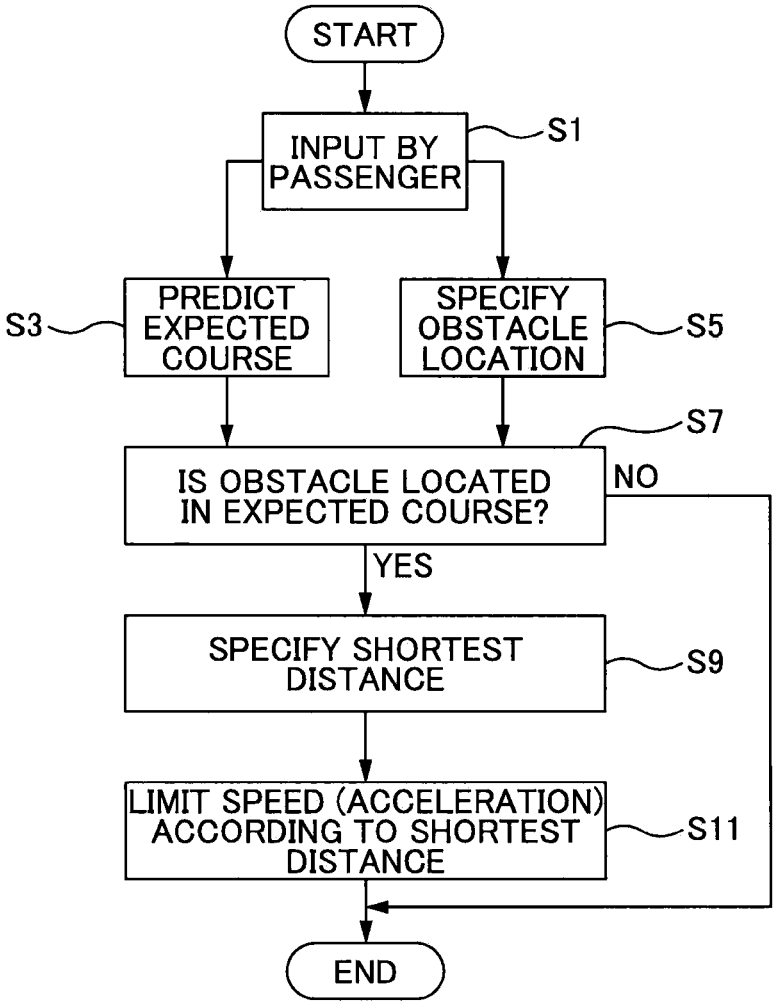
FIG. 5 is a flow diagram illustrating a risk reduction control.
Figure 6:
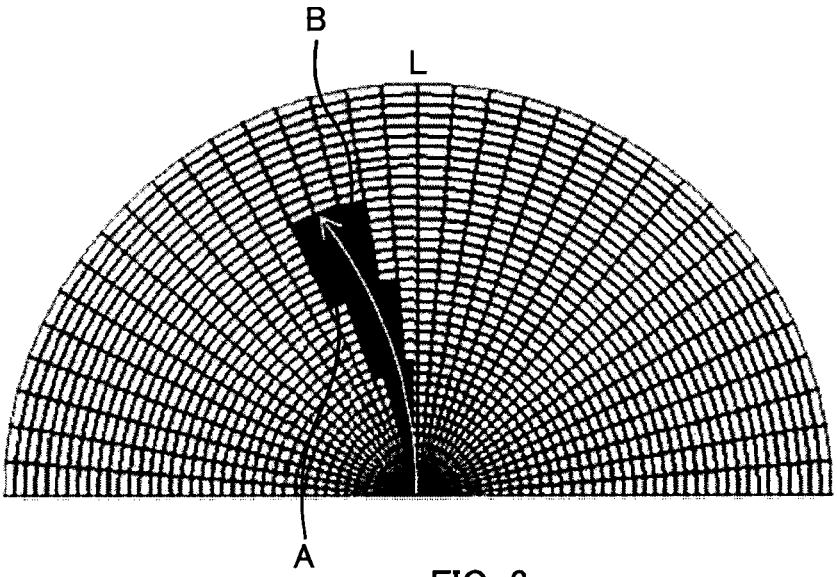
FIG. 6 is an explanatory diagram illustrating a determination method for determining whether or not an obstacle is located in an expected course.
Figure 7:
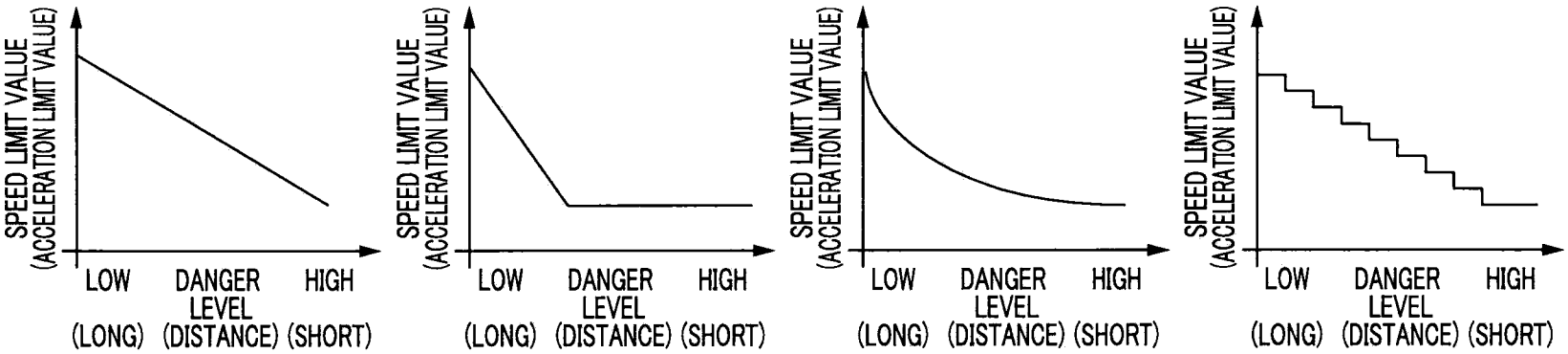
FIG. 7 shows schematic diagrams illustrating limit value setting rules.

In the following description, a further specific description will be given with reference to FIGS. 5 to 7. FIG. 5 is a flow diagram illustrating a risk reduction control. FIG. 6 is an explanatory diagram illustrating a determination method for determining whether or not an obstacle is located in an expected course. FIG. 7 is a schematic diagram illustrating the limit value setting rules.

Here, FIG. 6 describes two dimensional polar coordinates (non-rectangular grids), however in the following, the locations of the grids are described as <r, θ> for the sake of simplicity. Here, r does not indicate the distance but is a number (natural number) that indicates how many number of grids away from the wheelchair 10 in the radial direction it is. Further, θ does not indicate an angle but is a number (integer) that indicates how many grids away in the circumferential direction it is to the right (left). For example, θ=1 denotes the grid that is a single grid away to the right from the center line indicated with reference mark L, and θ=−1 denotes the gird that is a single grid away to the left from the center line. For example, in FIG. 6, the position of the grid indicated with reference mark A is <21, −5>. And, the position of the grid indicated with reference mark B is <29, −3>.

When the joy stick 40 is operated by the passenger so that the input information is input (Step S1), the controller 60 firstly predicts the expected course of the wheelchair 10 based on this input information (Step S3).

The prediction of the expected course is performed according to the following procedure. In other words, when the input information is input, the controller 60 obtains the linear assumed movement trace from when the input information is input until a predetermined time has passed, on the basis of the input information. In other words, this assumed movement trace is the path along which the wheelchair 10 moves when the input information (xjs, yjs) is continued to be input for the predetermined time (that is, when the instructed straight advancing speed v converted from xjs and the instructed turning speed w converted from yjs continue to be instructed for the predetermined time), and can be obtained by a well known method. An example of the assumed movement trace is shown with an arrow in FIG. 6.

Then the expected course is obtained based on the acquired assumed movement trace where the controller 60 in the present embodiment obtains, that is, predicts the expected course in grid units of the two dimensional polar coordinates, that is, circular polar coordinates with the wheelchair 10 at the center. In this way, the assumed movement trace is placed on the two dimensional polar coordinates as shown in FIG. 6. Thereafter, all the grids in which the assumed movement trace is included (called trace including grids) and the two side grids positioned on the two sides in the circumferential direction of the trace including grids are set as the expected course (the shaded parts in FIG. 6). Note that, the reason why not only the trace including grids but the grids on the two sides were set as the expected course in this way, is to allow judgment on whether or not there is an obstacle located in the expected course while taking into consideration the width of the wheelchair 10.

Further in the present embodiment, all the trace including grids in which the assumed movement trace is included and the two side grids positioned on the two sides, in the circumferential direction, of all the trace including grids are set as the expected course. And the number (two in the present embodiment, however, the number may be four or more depending on, for example, the aforementioned width) of grids on the two sides is set to be the same for all the trace including grids. In other words, the grid adjacent on the right side and the grid adjacent on the left side are set as the two side grids for all the trace including grids. Thus three grids arranged in the circumferential direction configure the expected course at all locations in the radial direction.

In the present embodiment, the length of a single grid in the radial direction is set to 25 centimeters and the angle of a single grid in the circumferential direction is set to five degrees, however, it is not limited to such and other values can be set accordingly.

Also, the controller 60, together with the prediction of the expected course, specifies the location of the obstacle based on the obstacle information acquired by the 3D laser range finder 50 (Step S5).

Description of the 3D laser range finder 50 will be given here. The 3D laser range finder 50 is for acquiring the obstacle information around the wheelchair 10. Specifically, the distance to the matter (obstacle) is obtained based on the time from when a laser is projected radially (three dimensionally) until the laser comes back after hitting the matter (obstacle). And the three dimensional coordinates (three dimensional location information) of the matter (obstacle) can be identified (acquired) since the distance to the matter (obstacle) can be obtained.

This 3D laser range finder 50 acquires the obstacle information at a predetermined sampling interval. And the controller 60 receives from the 3D laser range finder 50 obstacle information as a group of points having three dimensional location information of a timing similar to the timing when the prediction of the expected course is made. This "timing similar" here does not mean that there is no time difference at all but is a concept including a slight time difference.

And in the present embodiment, the controller 60 specifies whether or not an obstacle is located in grid units of the aforementioned two dimensional polar coordinates. And for such reason, when projecting on the two dimensional polar coordinates the aforementioned group of points of the three dimensional coordinates, the grid including the number of projected group of points exceeding the threshold value (e.g., ten) is set as the grid (hereinafter called obstacle grid for the sake of simplicity) in which the obstacle is positioned.

Next, the controller 60 determines whether an obstacle is located in the expected course (Step S7). Specifically, the controller 60 determines whether there is an obstacle grid existing in the expected course (group of grids) that is composed of the trace including grids and the grids on the two sides thereof.

Further, when determining that an obstacle is located in the expected course, the controller 60 also specifies the distance shortest to the obstacle located in the expected course (step S9).

Here, the determination of the shortest distance may be made for each of the group of points projected on the two dimensional polar coordinates, but is made in grid units for obtaining the benefits of a simplified computation in the present embodiment.

Description of an example will be given with reference to FIG. 6. Supposing for example, grids A and B in FIG. 6 were specified as obstacle grids in Step 5. Since the locations of the grids A and B in this case respectively are <21, −5> and <29, −3>, as explained above, the distance of A is 21 whereas the distance of B is 29. Here the aforementioned shortest distance is distance 21 of grid A.

Then the control of the moving members 30 is changed when the controller 60 determines that an obstacle is located (Step 7: YES). On the other hand, the control is not changed when the controller 60 determines that an obstacle is not located (Step: NO), that is, when there is no obstacle grid in the expected course (grid group). Specifically, the above control is performed on at least one of the moving speed and the acceleration of the wheelchair 10 (may be one or both in the present embodiment) so to not exceed the threshold value (Step S11). And this predetermined value is changed in accordance with the shortest distance specified in Step S9.

In other words, the controller 60 sets the speed and the acceleration limit values when an obstacle is determined to be located. And the moving members 30 are controlled (changes are made to the control) so that the speed does not exceed the speed limit value and the acceleration does not exceed the acceleration limit value. For example, if the instructed straight advancing speed v converted from xjs being the x coordinate of the joy stick 40 were to exceed the speed limit value, the instructed straight advancing speed v is replaced with the speed limit value to control the aforementioned moving members 30. And if the acceleration $(v_n - v_{n-1})/t$ which is calculated using the instructed straight advancing speed $v_n$ and the instructed straight advancing speed $v_{n-1}$ at time t before the sampling time were to exceed the acceleration limit value, the instructed straight advancing speed $v_n$ is replaced with a value that does not exceed the acceleration limit value to control the aforementioned moving members 30.

The speed and the acceleration limit values are both set, for example, based on the limit value setting rules indicated in FIG. 7. And although there are four diagrams illustrated in FIG. 7, all of them are illustrated with the same horizontal axes and the vertical axes. That is, the horizontal axes indicate the danger level (distance in the present embodiment, where the shorter the distance, the greater the danger level), and the vertical axes indicate the speed limit value or the acceleration limit value.

The limit value setting rules are defined such that the speed (acceleration) limit value becomes smaller as the danger level increases (the distance becomes shorter) in all of the four diagrams.

===Effectiveness of the Wheelchair 10 According to the Present Embodiment===

As explained above, the controller 60 of the wheelchair 10 according to the present embodiment predicts the expected course of the wheelchair 10 based on the aforementioned input information, determines whether there is an obstacle located in the expected course based on the obstacle information, and changes the control on the moving members 30 when an obstacle is determined to be located.

Therefore, the passenger's risk can be reduced as mentioned above.

Further in the present embodiment, the controller 60 predicts the expected course in grid units of the two dimensional polar coordinates with the wheelchair 10 at the center, and specifies whether or not there is an obstacle located in grid units.

And in such case, the size of the grids become smaller as the grids are located closer to the wheelchair 10 and become larger as the grids are located farther from the wheelchair 10, as shown in FIG. 6. In other words, the number of grids per unit area is larger (the grid density is higher) for the grids located closer to the wheelchair 10 compared to those located farther from the wheelchair 10.

Therefore, the grid density is higher at the closer locations where detailed determination is desired, whereas the grid density is lower at farther locations where rough determination will do (priority is rather placed on the simplicity of computation). In this way, an appropriate determination method can be realized in accordance with the distance from the wheelchair 10.

Further, when the 3D laser range finder 50 is used as the sensor, the number of data that can be acquired per unit area (per unit volume when before projection) increases (the data density becomes higher) for locations closer to the wheelchair 10 than those farther therefrom since the laser is projected radially (three dimensionally). And as mentioned above, the density of the grids are higher for those at locations closer to the wheelchair 10 than those at locations farther, so that the number of data per grid can be made to accord between those at locations far and those at locations close.

And in the present embodiment, when the controller 60 determines that an obstacle is located, at least one of the moving speed and the acceleration of the wheelchair 10 is controlled from exceeding the threshold value. In other words, the controller 60 has set a speed limit value and an acceleration limit value.

For the reason above, even if the wheelchair 10 were to collide with an obstacle, collision at a high moving speed and/or high acceleration can be avoided so that the risk (i.e., damage) of the passenger can be reduced appropriately.

And the controller 60 of the present embodiment specifies the shortest distance to an obstacle located in the expected course on the basis of obstacle information and changes the aforementioned predetermined value according to this shortest distance. That is, the controller 60 changes the speed limit value and the acceleration limit value according to this shortest distance.

For such reason, appropriate speed and acceleration limit values can be set in accordance with the danger level and thus allowing to effectively reduce the passenger's risk.

Further, the controller 60 of the present embodiment obtains the assumed linear movement trace from when the aforementioned input information is input until a predetermined time has passed therefrom, based on the input information, and sets as the expected course all the trace including grids in which the assumed movement trace is included and the two side grids positioned on the two sides, in the circumferential direction, of all the trace including grids.

Therefore, determination can be made on whether or not there is an obstacle located in the expected course, taking into consideration the width of the wheelchair 10 as mentioned above.

Furthermore, the controller 60 of the present embodiment sets all the trace including grids in which the assumed movement trace is included and the two side grids positioned on the two sides, in the circumferential direction, of all the above trace including grids, as the expected course, and sets the number of grids on the two sides to be the same for all the trace including grids.

For this reason, the width (hereinafter, called circumferential width for the sake of convenience) in the circumferential direction of the expected course becomes wider as the position is located farther from the wheelchair 10, as shown in FIG. 6. That is, determination on whether an obstacle is present or not is made while widening the circumferential width of the expected course as the distance from the wheelchair 10 increases. And therefore, this determination is made on the safer side for locations farther away from the wheelchair 10.

And such determination method is effective for cases where the obstacle detection accuracy of the sensor (3D laser range finder 50 and other types of sensors that are used instead) decreases at locations far from the wheelchair 10. In other words the passenger's risk can be appropriately reduced even when the obstacle detection accuracy of the sensor is reduced at locations far from the wheelchair 10.

===Modified Examples of the Aforementioned Embodiment===

Description of the modified examples of the aforementioned embodiment will be given in the following.

<<<Modified Examples Relating to the Setting of the Expected Course>>>

In the aforementioned embodiment, all the trace including grids in which the assumed movement trace is included and the two side grids positioned on the two sides, in the circumferential direction, of all the trace including grids were set as the expected course, and the number of grids on the two sides were set to be the same for all the trace including grids.

However, it is not limited to such and for example, all the trace including grids in which the assumed movement trace is included and the two side grids positioned on the two sides, in the circumferential direction, of some of the trace including grids can be set as the expected course. And also, the number of grids on the two sides may differ according to the trace including grids.

In the following, specific examples will be given with reference to FIGS. 8 to 12. FIG. 8 is a diagram illustrating a grid configuration of the expected course according to a first modified example. FIG. 9 is a diagram illustrating a grid configuration of the expected course according to a second modified example. FIG. 10 is a diagram illustrating a grid configuration of the expected course according to a third modified example. FIG. 11 is a diagram illustrating a grid configuration of the expected course according to a fourth modified example. FIG. 12 is a diagram illustrating a grid configuration of the expected course according to a fifth and sixth modified examples.

First Modified Example and Second Modified Example

The first modified example is similar to the aforementioned embodiment on the point that all the trace including grids in which the assumed movement trace is included and the two side grids positioned on the two sides, in the circumferential direction, of all the trace including grids are set as the expected course, however, differs from the aforementioned embodiment on the point that the number of grids on the two sides are set to differ according to the trace including grids. In other words, as shown in FIG. 8, for grids closer to the wheelchair 10 in the radial direction (i.e., grids whose r coordinate is smaller than N (a natural number)) has two grids on the two sides (one on each of the left and right sides), and for grids farther from the wheelchair 10 (i.e., grids whose r coordinates is equal and or greater than N) has four grid on the two sides (two on each of the left and right sides).

In other words, the expected course is set such that the number of grids (specifically two) of the first both side grids positioned on the two sides, in the circumferential direction, of the first trace including grid (i.e., grids whose r coordinate is smaller than N) is less than the number of grids (specifically four) of the second both side grids positioned on the two sides, in the circumferential direction, of the second trace including grid (i.e., grid whose r coordinate is N and greater) that is positioned at a location farther than the first trace including grids when seen radially from the wheelchair 10.

And in such case, the width of the expected course in the circumferential direction is further widened at a location far from the wheelchair 10, than the case illustrated in FIG. 6. Thus the first modified example is preferred to be used for a case where the obstacle detection accuracy of the sensor (3D laser range finder 50 and other types of sensors that are used instead) is further reduced at a location far from the wheelchair 10. In other words, according to the first modified embodiment, the passenger's risk can be appropriately reduced even in the case where the accuracy of the sensor is further reduced at a location far from the wheelchair 10.

Note that, the overall circumferential width of the expected course can be narrowed compared to the first modified example when the wheelchair 10 has a narrow width or when the passenger carrying mobile robot, other than the wheelchair 10, has a narrow width.

The second modified example is an example assuming the above circumstances, and as illustrated in FIG. 9, the number of grids on the two sides is set to zero (i.e., no grids are provided on the two sides) for grids that are located closer (i.e., grids whose r coordinate is smaller than N) to the wheelchair 10 in the radial direction, and the number of grids on the two sides is set to two (one on each of the left and right sides) for grids that are located farther away (i.e., grid whose r coordinate is equal to N and greater) from the wheelchair 10.

Note that, as can be easily understood from the above description, the "number of grids" of the grids on the two sides are zero, two, four and so on and thus the "number of grids" is a concept defined (a term that can be used) for also the case where there is no grid (when the grid number is zero) on the two sides.

And also in this case of the second modified example, the expected course is set such that the number of grids (specifically zero) on the two sides, in the circumferential direction, of the first grid of the first trace including grids (i.e., grids whose r coordinate is smaller than N) is less than the number of grids (specifically two) on the two sides, in the circumferential direction, of the second grid of the second trace including grids (i.e., grids whose r coordinate is equal to N and greater) that is positioned at a location radially farther from the wheelchair 10 than the first trace including grids, and thus there is an effect similar to the first modified example.

Third Modified Example and Fourth Modified Example

Such as when the obstacle detecting accuracy of the sensor is relatively acceptable in also the location far from the wheelchair 10, there are cases where the width of the expected course in the circumferential direction is preferred to be widened at locations close to the wheelchair 10 rather than making this width in the circumferential direction widened at locations far from the wheelchair 10. In other words, since there is only a short time for bypassing an obstacle when the obstacle is located close to the wheelchair 10, there are cases where it is preferable for a judgment, on whether or not an obstacle exists, to be made on the safe side at locations closer to the wheelchair 10.

The third modified example is an example that assumes the above matter and as illustrated in FIG. 10, the number of grids on the two sides is set to eight (four on each of the left and right sides) for grids closer (i.e., grids whose r coordinate is smaller than N) to the wheelchair 10 in the radial direction, and the number of grids on the two sides is set to two (one on each of the left and right sides) for grids that are farther (i.e., grids whose r coordinate is N and greater) from the wheelchair 10.

In other words, the expected course is set such that the number of grids (specifically eight) of the first two side grids positioned on both sides in the circumferential direction of the first trace including grid (i.e., grids whose r coordinate is smaller than N) is more than the number of grids (specifically two) of the second two side grids positioned on both sides in the circumferential direction of the second trace including grids (i.e., grids whose r coordinate is N and greater) that is positioned at a location radially farther from the wheelchair 10 than the first trace including grids.

And in this case, as mentioned above, the passenger's risk can be appropriately reduced even if there were an obstacle at a location close to the wheelchair 10. Also, although there is no specific limit to the value of N, it is preferable that it is set as close (e.g., N=5) to the wheelchair 10 as possible.

Note that similar to the second modified example, an example assuming that the wheelchair 10 has a narrow width or the passenger carrying mobile robot, other than the wheelchair 10, has a narrow width is illustrated in FIG. 11 as the fourth modified example.

Fifth Modified Example

As mentioned above, when the input information is input, the controller 60 obtains the assumed movement trace from when this input information is input until a predetermined time has passed therefrom on the basis of the input information. And this assumed movement path is the trail along which the wheelchair 10 follows when the input information (xjs, yjs) has been kept being input for the aforementioned predetermined time (that is, when the instructed straight advancing speed v converted from xjs and the instructed turning speed w converted from yjs has been kept being instructed for the predetermined time). Thus the assumed movement trace becomes longer as the input information xjs (i.e., instructed straight advancing speed v) is larger.

Meanwhile, it would be difficult for the wheelchair 10 to make a sharp turn when the moving speed of the wheelchair 10 is high compared to when the moving speed is low.

Therefore, the fifth modified example has the controller 60 change the number of grids on the two sides according to the length of the assumed movement trace. In other words the controller 60 reduces then number of grids on the two sides when the length of the assumed movement trace is long meaning that the movement speed is high and a sharp turn is difficult to be made, on the other hand increases the number of grids on the two sides when the length of the assumed movement trace is short meaning that the movement speed is low and a sharp turn can be easily made.

For example, as shown in FIG. 12, when the length "1" of the assumed movement trace is equal to L or greater, the numbers of grids on the two sides are all set to two regardless of the location of the grid in the radial direction, similar to the case shown in FIG. 6. And the controller 60 increases the numbers of grids on the two sides by two to be four when the length "1" of the assumed movement trace is shorter than L.

And in this case, an expected course appropriately taking into consideration the ease to turn the wheelchair 10 can be set, as mentioned above.

The number of grids may be changed by specifying the length of the assumed movement path and then comparing the length with the threshold value, as a specific way of controlling, but the number of grids may be changed by comparing to the threshold value the input information xjs or the instructed straight advancing speed v, instead of this length. These cases also fall under the category of the process of changing the number of grids on the two sides according to the length of the assumed movement trace.

Sixth Modified Example

An example was given in the fifth modified example where the number of grids on the two sides was changed according to the length of the assumed movement trace, in other words, the instructed straight advancing speed v, however, there are cases where the actual movement speed greatly differs from the instructed straight advancing speed v. For example, there is a case where the actual moving speed is faster than the instructed straight advancing speed v when the wheelchair 10 moves along a downward slope.

Being the case, the sixth modified embodiment has provided to the wheelchair 10 a second sensor different from the 3D laser range finder 50 (first sensor) and acquires the actual moving speed of the wheelchair 10 with the second sensor. Then the assumed moving trace is reset based on the acquired actual moving speed and the number of grids of the aforementioned two side grids is changed according to the length of the reset assumed moving trace.

The second sensor may be a sensor that directly or indirectly detects (e.g., a sensor that monitors the current value or the voltage value of the motors 36) the actual moving speed. And for example, the controller 60 resets the assumed movement trace based on the actual moving speed (not the instructed straight advancing speed v) when the difference between the actual moving speed and the instructed straight advancing speed v exceeds the threshold value. Therefore, for example, the length of the assumed movement trace is elongated by the resetting process when the wheelchair 10 moves along a downward slope.

Further the number of grids on the two sides are changed according to the length of this reset assumed movement trace in the same way as that in the fifth modified example (FIG. 12). Thus, for example, the number of grids is reduced when the wheelchair 10 moves along a downward slope.

And in this case, an expected course appropriately taking into consideration the actual moving speed can be set, as mentioned above.

<<<Modified Example Relating to the Limit Value Setting Rule>>>

In the above embodiment, the aforementioned predetermined values (i.e., the speed limit value and the acceleration limit value) were changed according to the shortest distance to the obstacle located in the expected course. This will be called the present example for the sake of convenience. However, it is not limited to such and the changes can be made in accordance with other parameters.

Figure 13:
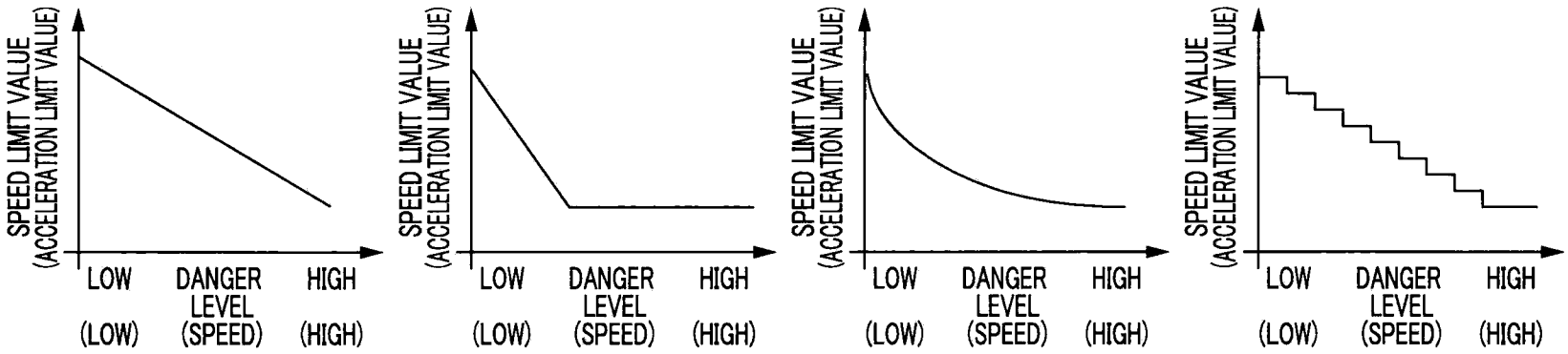
FIG. 13 shows schematic diagrams illustrating limit value setting rules according to a seventh modified example.
Figure 14:
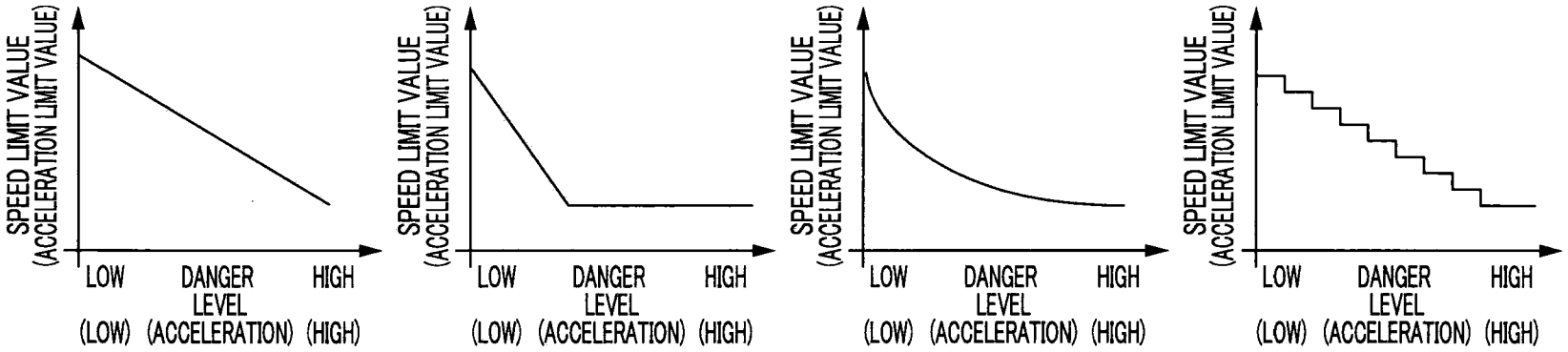
FIG. 14 shows schematic diagrams illustrating limit value setting rules according to an eighth modified example.
Figure 15:
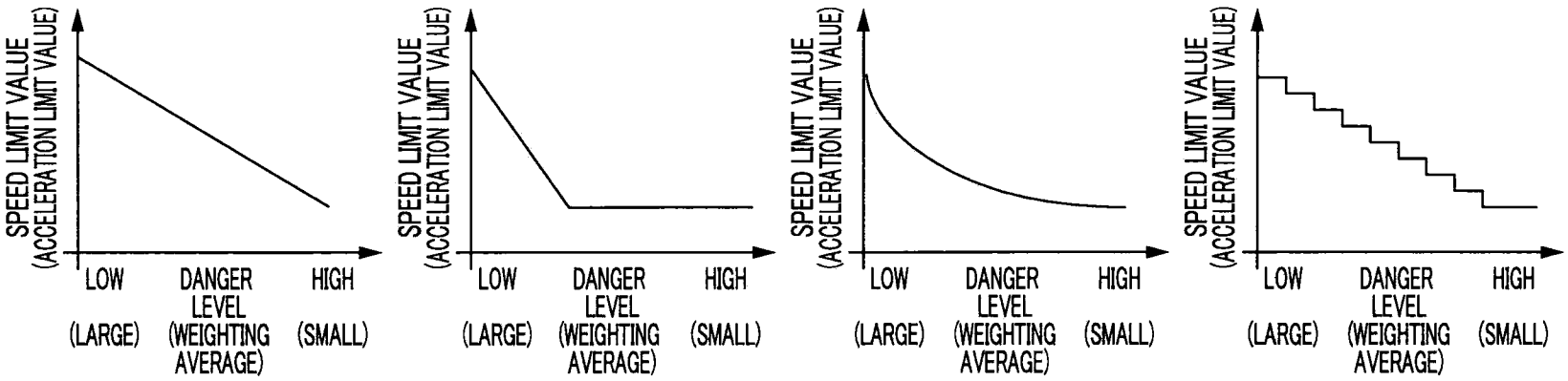
FIG. 15 shows schematic diagrams illustrating limit value setting rules according to a ninth modified example.

Specific examples will be given with reference to FIG. 13 to FIG. 15 in the following. FIG. 13 shows schematic diagrams illustrating the limit value setting rules according to a seventh modified example, FIG. 14 shows schematic diagrams illustrating the limit value setting rules according to an eighth modified example, and FIG. 15 shows schematic diagrams illustrating the limit value setting rules according to a ninth modified example.

Seventh Modified Example

In the seventh modified example, the controller 60 specifies the shortest distance to the obstacle located in the expected course at two time points that are different from each other based on respective obstacle information, and the aforementioned predetermined value (speed limit value and acceleration limit value) is changed according to the speed obtained based on the two shortest distances.

For example, the controller 60 obtains the speed of the obstacle $(d_{n-1}-d_n)/t$ from the shortest distance $d_n$ to the obstacle located in the expected course and the shortest distance $d_{n-1}$ thereof at time t before this sampling time. Note that in this modified example, determination is not made on whether or not the obstacle related to the shortest distance $d_n$ is the same as the obstacle related to the shortest distance $d_{n-1}$ for the sake of simplicity of the computation. In other words each of the shortest distances $d_n$ and $d_{n-1}$ are specified independently. This holds true for the eighth and ninth modified examples. And the speed and acceleration limit values are set by applying this speed $(d_{n-1}-d_n)/t$ to any one of the limit value setting rules indicated in FIG. 13.

There are four diagrams illustrated in FIG. 13, however, all of them have the same horizontal and vertical axes. In other words, the horizontal axes indicate the danger level (speed of the obstacle in the seventh modified example, and the danger level is raised along with the increase in the speed of the obstacle) and the vertical axes indicate the speed limit value or the acceleration limit value.

Additionally, the limit value setting rules are defined such that the speed limit value (acceleration limit value) is reduced when the danger level is high (speed is high) in all four diagrams.

And also in this case, similar to the present example, an appropriate speed limit value and an appropriate acceleration limit value can be set according to the danger level so that the passenger's risk can be effectively reduced.

Eighth Modified Example

In the eighth modified example, the controller 60 specifies the shortest distance to the obstacle located in the expected course at three different time points based on the respective obstacle information, and the aforementioned predetermined values (the speed limit value and the acceleration limit value) are changed according to the acceleration obtained based on the three shortest distances.

For example, the controller 60 obtains the speed $(d_{n-1}-d_n)/t$, $(d_{n-2}-d_{n-1})/t$ of the obstacle using the shortest distance $d_n$ to the obstacle located in the expected course, the shortest distance $d_{n-1}$ at time t before this sampling and the shortest distance $d_{n-2}$ at further time t before this earlier sampling. And, the acceleration $((d_{n-2}-d_{n-1})/t-d_{n-1}-d_n)/t)/t$ of the obstacle is obtained using the above two speeds.

Here, the speed limit value and the acceleration limit value are set by applying this acceleration $((d_{n-2}-d_{n-1})/t-d_{n-1}-d_n)/t)/t$ to one of the limit value setting rules shown in FIG. 14.

The four diagrams shown in FIG. 14 all have the same horizontal and vertical axes. In other words, the horizontal axes indicate the danger level (acceleration of the obstacle in the eighth modified example, and the danger level is raised along with the increase in the acceleration of the obstacle) and the vertical axes indicate the speed limit value or the acceleration limit value.

And the limit value setting rules are defined such that the speed limit value (acceleration limit value) is reduced when the danger level is high (acceleration is high) in all four diagrams.

And also in this case, similar to the present example, an appropriate speed limit value and an appropriate acceleration limit value can be set according to the danger level so that the passenger's risk can be effectively reduced.

Ninth Modified Example

The controller 60 of the ninth modified example specifies the shortest distance to the obstacle located in the expected course at two or three time points (three time points in the present example) that are different from each other based on respective obstacle information, and the aforementioned predetermined values (speed limit value and acceleration limit value) are changed according to the weighting function being a function having weighted at least two variables (three (all) variables in this example) among the single shortest distance, the speed obtained based on two shortest distances, and the acceleration obtained based on the three shortest distances.

The controller 60 for example, specifies (obtains) the aforementioned shortest distance $d_n$ (shortest distance D in this example), speed $(d_{n-1}-d_n)/t$ (speed V in this example), and acceleration $((d_{n-2}-d_{n-1})/t-(d_{n-1}-d_n)/t)/t$ (acceleration A in this example), and generates the weighted average thereof (the weighted average has been given as an example of the weighting function, however, it is not limited to such). The weighted average is $(w_d\times(D_{max}-D)+w_v\times V+w_a\times A)/(w_d+w_v+w_a)$. Here, $D_{max}$ is a constant and for example, is the maximum distance detectable by the 3D laser range finder 50. The reason why only D is attached a minus sign is because the danger level is increased as the shortest distance becomes shorter, different from the speed and the acceleration.

And since this weighting average can be an index that indicates the danger level, the speed limit value and the acceleration limit value are set by applying this weighting average to any of the limit value setting rules shown in FIG. 15.

The four diagrams shown FIG. 14 all have the same horizontal and vertical axes. In other words, the horizontal axes indicate the danger level (weighted average in the ninth modified example, and the danger level is raised along with the increase in the weighted average) and the vertical axes indicate the speed limit value or the acceleration limit value.

Additionally, the limit value setting rules are defined such that the speed limit value (acceleration limit value) is reduced when the danger level is high (the weighted average becomes large) in all four diagrams.

And in also such case, similar to the present example, an appropriate speed limit value and an appropriate acceleration limit value can be set according to the danger level so that the passenger's risk can be effectively reduced.

<Regarding the Combination of Modified Examples and the Like>

Note that the limit value setting rules according to the aforementioned present example, the seventh modified example, the eight modified example and the ninth modified example can be used in combination. In other words, two or more of these examples can be used concurrently.

For example, when the limit value setting rule according to the present example is used concurrently with the limit value setting rule according to the seventh example, the speed limit value (acceleration limit value) according to the shortest distance and the speed limit value (acceleration limit value) according to the speed can be obtained. And in this example, a smaller (strict) speed limit value (acceleration limit value) is to be employed.

===Other Embodiments===

The aforementioned embodiments are intended to facilitate the understanding of the present invention but are not intended to impose limitation on the interpretation of the present invention. It is a matter of course that the present invention can be altered or modified without departing from the spirit of the present invention, and also includes equivalents of the present invention. In particular, the following embodiment is also included in the present invention.

In the aforementioned embodiment, description was given with the joy stick 40 as an example of the single operated member operated by the passenger for instructing both the moving direction and the moving speed of the passenger carrying mobile robot, however, it is not limited to such. For example, a game controller, a mouse, a trackball or a touch panel may be used instead. Further, the "single operated member" means to exclude the case where a plurality of independent operated members is used when the passenger instructs the moving direction and the moving speed. Thus instructions given with a plurality of independent operated members (i.e., handle and axel) in an ordinary automobile is not included in the present invention.

Note that, the "single operated member" does not prohibit the operated part from being divided into two or more parts. For example, the joy stick 40 that is configured of two parts of a stick-like grip and a supporting part that movably supports the grip is included in the "single operated member".

Further in the aforementioned embodiment, description was given with the wheels 32 as the moving members and the motors 36 for rotating the wheels 32, however, it is not limited to such. For example, legs (feet) for walking may be used instead of the wheels 32.

In this way, description was given with the wheelchair 10 as an example of the passenger carrying mobile robot in the aforementioned embodiment, however, it is not limited to such and a walking robot may do, for example. Note that as mentioned above, a so-called automobile is not included in the passenger carrying mobile robot.

Further, description was given in the aforementioned embodiment taking the 3D laser range finder 50 as an example of the sensor (first sensor), however, it is not limited such and a camera or a radar, for example, may do.

Furthermore, a display part (hereinafter called the display device 70) that displays the aforementioned expected course and the obstacle that is located in the expected course may be included.

For example, an image such as that shown in FIG. 6 may be made to be displayed at real time on the display device 70 such as a liquid display device. In this way, the passenger can appropriately recognize the expected course and the obstacle located in the expected course so that the passenger's risk can be further reduced.

Note that the image shown in FIG. 6 has illustrated a linear assumed movement trace, however, this assumed movement trace need not be displayed on the display device 70. And it is preferable for the obstacle grids attached with the reference marks A and B in the image shown in FIG. 6 to be colored in a color different from the other grids that configure the expected course. Further the girds on the farther side in the radial direction with respect to the obstacle grid (i.e., all the grids whose e coordinate is the same as that of the obstacle grid and whose r coordinate is greater than that of the obstacle grid) are in a blind area which cannot be seen from the passenger and thus it is preferable that these grids are colored as the blind area in a color different from the other grids.

Further, the display device 70 may be a touch panel having a function of the aforementioned operated member. And the display device 70 may be provided to the front glass and the like in a state so to be overlaid on the scenery at the front side of the passenger carrying mobile robot.

The controller 60 changes the control on the moving member 30 when determining that an obstacle is located, but the wheelchair 10 may also have a notifying part that notifies that the control has been changed.

For example, when a speaker 80 is provided as the notifying part and when the aforementioned speed limit and/or the acceleration limit is set, this setting and/or the specific value thereof may be issued from the speaker 80. Further, the shortest distance to the obstacle, the speed and the acceleration may be issued from the speaker 80.

And when the speed limit and/or the acceleration limit is set, the settings and/or their specific values may be displayed on the display device 70 that is the notifying part. Further, the shortest distance to the obstacle, the speed and the acceleration may be displayed on the display part 70.

When a vibration mechanism that vibrates the wheelchair (e.g., the main body of the wheelchair or the joy stick 40), as the notifying part, is provided and the speed limit and/or acceleration limit is set, the settings may be notified by vibration. Further the level of the speed limit, the acceleration limit, the shortest distance to an obstacle, the speed and the acceleration can be notified by the strength of vibration.

The passenger is warned in such cases so that the passenger's risk can be further reduced.

Figure 16:
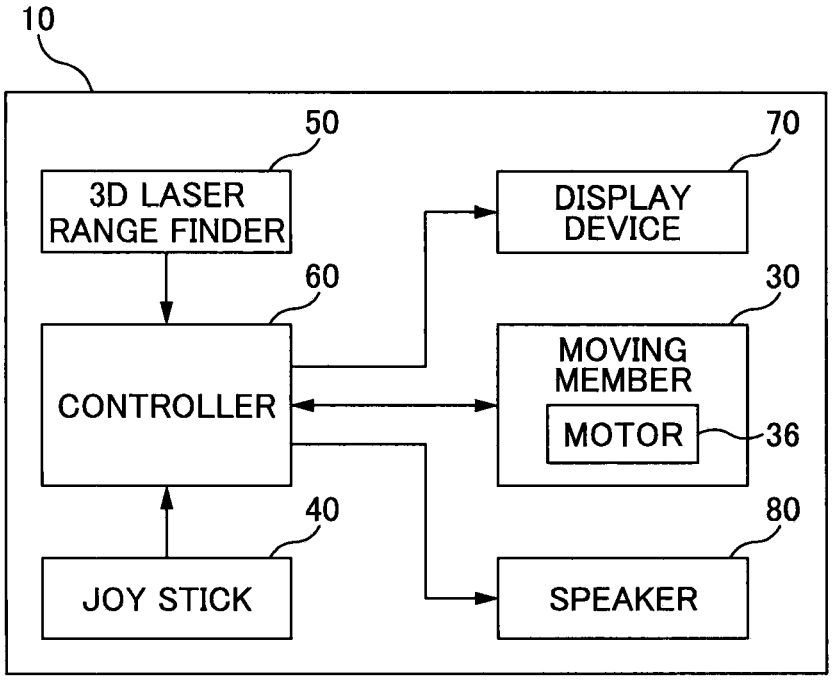
FIG. 16 is a block diagram illustrating an internal configuration of the wheelchair 10 having a display function and a notification function.

An example of the wheelchair 10 having such a display function and a notification function is shown in the block diagram of FIG. 16, similar to FIG. 2.

As described above, when the controller 60 determines that an obstacle is located in the expected course, at least one of the moving speed and the acceleration of the wheelchair 10 is controlled from exceeding the predetermined value (such control is called the speed and/or acceleration limiting process for the sake of convenience, refer to Step S7: YES in FIG. 5), and on the other hand when the controller 60 determines that an obstacle is not located in the expected course when the speed and/or acceleration limiting process is being performed, this speed and/or acceleration limiting process may be cancelled after a predetermined time has passed after performing this speed and/or acceleration limiting process.

To be specific, when the controller 60 determines that an obstacle is not located in the expected course (assuming that this determination is made at t=0 in FIG. 17) in the state where the speed limit value (acceleration limit value) is set, the speed limit (acceleration limit) is not immediately cancelled but the speed limit (acceleration limit) is cancelled after a predetermined time (indicated as time T in FIG. 17) has passed. In this way, the speed limit value (acceleration limit value) is maintained even if an obstacle is not located in the expected course during this time T.

And hereby, the following benefits are obtained. Specifically, there may be a case where the passenger inclines the joy stick 40 for a moment to a direction different from that intended by the passenger during operation of the joy stick 40. This may occur, for example, when the wheelchair 10 rocks because of the bumps on the ground. And in such case, there is a possibility that the state in which an obstacle is located in the expected course is moved to a state in which an obstacle is not located, however, the state can be returned at an instant to that having the obstacle located in the expected course when the passenger recovers to make the desired operation.

And when the speed limit value (acceleration limit value) is cancelled after a predetermined time has passed, the speed limit (acceleration limit) need not be cancelled in cases as that above. In other words, the speed limit and/or the acceleration limit can be cancelled after the security is confirmed along with the passing of sufficient time.

Further, the aforementioned predetermined value can be made to be increased when the predetermined value (speed limit value and/or the acceleration limit value) is maintained for a predetermined time.

Figures 18, 19, 20:
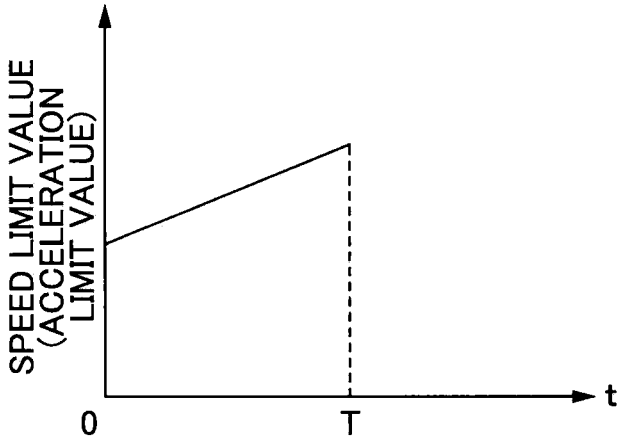
FIG. 18 is an explanatory diagram illustrating another method of canceling a speed limit or an acceleration limit.
FIG. 19 is an explanatory table illustrating a method of setting a threshold value.
FIG. 20 is an explanatory table illustrating a method of setting a weighting value.

To be specific, if the controller 60 determines that an obstacle is not located in the expected course when the speed limit value (acceleration limit value) is set (this determination is assumed to be made at t=0 in FIG. 18), as shown in FIG. 18, the speed limit (acceleration limit) is not immediately cancelled but the speed limit value (acceleration limit value) is gradually increased (i.e., the speed limit (acceleration limit) is gradually eased). And the speed limit (acceleration limit) is cancelled in the end after a predetermined time (indicated as time T in FIG. 18) has passed.

Hereby, the potential of the security is increased along with the passing of time (from t=0 to t=T) so that the speed limit (acceleration limit) can be eased as the potential of the security is increased.

Figure 17:
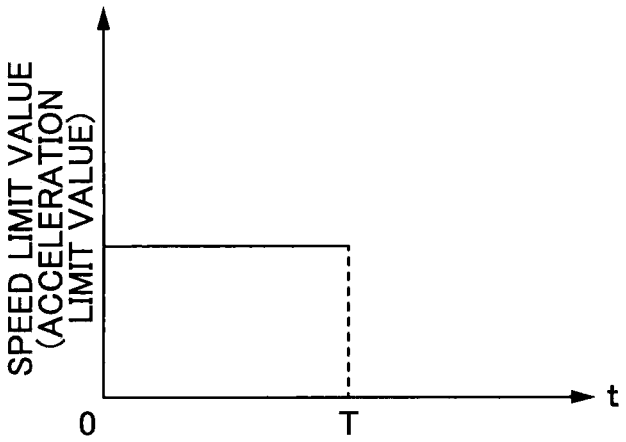
FIG. 17 is an explanatory diagram illustrating a method of canceling a speed limit or an acceleration limit.

It is a matter of course that a new speed limit value (acceleration limit value) is set when the controller 60 determines once again that an obstacle is located in the expected course during the time T, in the examples shown in FIGS. 17 and 18.

As mentioned above, the controller 60 according to the aforementioned embodiment receives from the 3D laser range finder 50 obstacle information as a group of points having three dimensional position information and sets a grid as the grid in which the obstacle is located when the number of group of points included in the grid, as a result of projecting a group of points on the two dimensional polar coordinates, exceeds a threshold value, however, this threshold may be changed according to the position of the grid in the radial direction.

For example, the grids located closer (i.e., grids whose r coordinate is smaller than N (natural number)) to the wheelchair 10 in the radial direction, as shown in FIG. 19, has set the threshold value to 10 and the grids located farther (i.e., grids whose r coordinate is equal to N and greater) from the wheelchair 10 has set the threshold value to five.

In other words, the threshold value is set such that the threshold value (specifically 10) of the first grid (i.e., grids whose r coordinate is smaller than N) is greater than the threshold value (specifically five) of the second grid (i.e., grids whose r coordinate is equal to and greater than N) that is positioned at a location farther from the first grid in the radial direction when seen from the wheelchair 10.

And this setting method is effective for cases when the obstacle detecting accuracy of the sensor (3D laser range finder 50 and other types of sensors that are used instead) decreases at locations far from the wheelchair 10. That is, determination on the obstacle grid can be easily performed for grids at farther locations than those at closer locations, when the threshold value is changed in the above manner, and thus determination on whether or not an obstacle is positioned is made on the safe side. Hereby, the passenger's risk can be appropriately reduced even when the obstacle detecting accuracy of the sensor decreases at locations far from the wheelchair 10.

Note that, the changing of the threshold value according to the position of the grid in the radial direction can be performed in the following manner. In other words, a coefficient to be multiplied to the group of points included in the aforementioned grid is set and the product of this number of the group of points and the coefficient is compared to the threshold value. And the coefficient, not the threshold value (the threshold value is not changed), is changed according to the position of the grid in the radial direction. It is a matter of course that this method substantially does not differ from changing the threshold value and thus is within the range of the present invention that changes the threshold value according to the position in the radial direction of the grid.

Further as mentioned above, the controller 60 according to the aforementioned embodiment receives obstacle information as a group of points having three dimensional location position information from the 3D laser range finder 50, however, a weighting value may be set, to each point in the group of points, according to the location in the height direction of the points, and may set a grid as the grid in which the obstacle is located when the total weighting values of the aforementioned group of points included in the grid, as a result of projecting a group of points on the two dimensional polar coordinates, exceeds the threshold value.

For example as shown in FIG. 20, scores (called weighting value for the sake of convenience) are set to each of the points according to the location (to be accurate, the location in the z axis direction when the group of points having three dimensional position information defined by the xyz axes are projected on two dimensional polar coordinates) in the vertical direction in which the group of points are located. When the height h of the point of the group of points (i.e., z coordinate) is smaller than N, the weighting value is set to "one" taking into consideration that the wheelchair 10 is assumed collide with an obstacle no matter who is on the wheelchair 10 and no matter what kind of posture the passenger is taking. On the other hand, when the height h (i.e., z coordinate) of the points of the group of points is equal to N or greater, the weighting value is set to 0.5 since there can be assumed cases where collision with an obstacle does not take place (e.g., cases of a child with a low seating height).

And the grid is set as the grid in which the obstacle is located when the total weighting values of the group of points included in the grid, that is, (number of group of points included in the grid and whose h is smaller than N)×1+(number of group of points included in the grid and whose h is equal to and greater than N)×0.5, as a result of projecting a group of points on then two dimensional polar coordinates, exceeds the threshold value.

In such case, a further appropriate determination on the obstacle can be made by taking into consideration the significance (weight) of each point in the group of points.

What is claimed is:

1. A single passenger carrying mobile robot, comprising:

a single operated member that is operated by a passenger to instruct both a moving direction and a moving speed of the passenger carrying mobile robot;

a moving member configured to move the passenger carrying mobile robot; and a controller that is configured to control the moving member based on input information input to the operated member by the passenger, wherein the passenger carrying mobile robot further includes a sensor that acquires obstacle information of a surrounding of the passenger carrying mobile robot, wherein the controller predicts an expected course of the passenger carrying mobile robot based on the input information, determines based on the obstacle information whether an obstacle is located in the expected course, and changes a control of the moving member in response to determining based on the obstacle information that an obstacle is located in the expected course, wherein the controller predicts the expected course in grid units of two dimensional polar coordinates with the passenger carrying mobile robot at a center and uses the grid units in determining whether the obstacle is located in the expected course, wherein the controller obtains a linear assumed movement trace, starting from when the input information is input until a predetermined time has passed, based on the input information, and wherein the controller sets, as the expected course, a set of trace-including grids in which the linear assumed movement trace is included, each of the set of trace-including grids having an associated set of side grids positioned on each side in a circumferential direction, wherein the expected course is set such that the number of side grids in the set of side grids associated with a first trace-including grid is greater than the number of side grids in the set of side grids associated with a second trace-including grid positioned at a location farther in a radial direction than the first trace-including grid when seen from the passenger carrying robot.

2. The passenger carrying mobile robot according to claim 1, wherein the controller changes the number of grids of the two side grids according to the length of the assumed movement trace.

3. The passenger carrying mobile robot according to claim 2, wherein the sensor is a first sensor, and the passenger carrying mobile robot includes a second sensor different from the first sensor, and the controller acquires an actual moving speed of the passenger carrying mobile robot from the second sensor, resets the assumed movement trace based on the actual movement speed acquired, and changes the number of grids of the two sides grids according to the length of the reset assumed movement trace.

4. The passenger carrying mobile robot according to claim 1, wherein the number of grids of the two side grids is the same for all of the trace including grids.

5. A single passenger carrying mobile robot, comprising:

a single operated member that is operated by a passenger to instruct both a moving direction and a moving speed of the passenger carrying mobile robot;

a moving member configured to move the passenger carrying mobile robot; and a controller that is configured to control the moving member based on input information input to the operated member by the passenger, wherein the passenger carrying mobile robot further includes a sensor that acquires obstacle information of a surrounding of the passenger carrying mobile robot, wherein the controller predicts an expected course of the passenger carrying mobile robot based on the input information, determines based on the obstacle information whether an obstacle is located in the expected course, and changes a control of the moving member in response to determining based on the obstacle information that an obstacle is located in the expected course, wherein the controller predicts the expected course in grid units of two dimensional polar coordinates with the passenger carrying mobile robot at a center and uses the grid units in determining whether the obstacle is located in the expected course, wherein the controller receives from the sensor the obstacle information as a group of points having three dimensional location information, wherein the controller sets a grid as the grid in which the obstacle is positioned when the group of points is projected on the two dimensional polar coordinates and a number of the group of points included in the grid exceeds a threshold value, and wherein the controller changes the threshold value according to a location in a radial direction of the grid.

6. The passenger carrying mobile robot according to claim 5, wherein the controller causes at least one of the moving speed and an acceleration of the passenger carrying mobile robot not to exceed a predetermined value when determining that the obstacle is located in the expected course.

7. The passenger carrying mobile robot according to claim 6, wherein the controller specifies based on the obstacle information a shortest distance to the obstacle located in the expected course and changes the predetermined value according to the shortest distance.

8. The passenger carrying mobile robot according to claim 6, wherein the controller respectively specifies based on the obstacle information a shortest distance to the obstacle located in the expected course at two time points that are different from each other and changes the predetermined value as applied to the moving speed according to the respective shortest distances obtained at the two time points.

9. The passenger carrying mobile robot according to claim 6, wherein the controller respectively specifies based on the obstacle information a shortest distance to the obstacle located in the expected course at three time points that are different from each other and changes the predetermined value as applied to acceleration according to the respective shortest distances obtained at the three time points.

10. The passenger carrying mobile robot according to claim 6, wherein the controller respectively specifies based on the obstacle information a shortest distance to the obstacle located in the expected course at each of plural time points that are different from each other and changes the predetermined value according to a weighting function that respectively weights at least two variables each variable based on a different parameter selected from the group consisting of: (1) the shortest distance to the obstacle located in the expected course at one of the plural time points, (2) the shortest distances to the obstacle located in the expected course at two of the plural time points and being applied to moving speed of the passenger carrying mobile robot, and (3) the shortest distances to the obstacle located in the expected course at three of the plural time points and being applied to acceleration of the passenger carrying mobile robot.

11. The passenger carrying mobile robot according to claim 6, wherein the controller when determining that the obstacle is located in the expected course, performs a speed and/or acceleration limiting process that performs the control causing at least one of the moving speed and the acceleration of the passenger carrying mobile robot not to exceed the predetermined value and cancels the speed and/or acceleration limiting process after maintaining the speed and/or acceleration limiting process for a predetermined time, when determining that the obstacle is not located in the expected course during the speed and/or acceleration limiting process.

12. The passenger carrying mobile robot according to claim 11, wherein the controller increases the predetermined value when the speed and/or acceleration limiting process is maintained for the predetermined time.

13. The passenger carrying mobile robot according to claim 5 including a display part that displays the expected course and the obstacle located in the expected course.

14. The passenger carrying mobile robot according to claim 5 including a notifying part that notifies that the control has changed.

15. The passenger carrying mobile robot according to claim 5, wherein the passenger carrying mobile robot is a wheelchair.

16. A single passenger carrying mobile robot, comprising:

a single operated member that is operated by a passenger to instruct both a moving direction and a moving speed of the passenger carrying mobile robot;

a moving member configured to move the passenger carrying mobile robot; and a controller that is configured to control the moving member based on input information input to the operated member by the passenger, wherein the passenger carrying mobile robot further includes a sensor that acquires obstacle information of a surrounding of the passenger carrying mobile robot, wherein the controller predicts an expected course of the passenger carrying mobile robot based on the input information, determines based on the obstacle information whether an obstacle is located in the expected course, and changes a control of the moving member in response to determining based on the obstacle information that an obstacle is located in the expected course, wherein the controller predicts the expected course in grid units of two dimensional polar coordinates with the passenger carrying mobile robot at a center and uses the grid units in determining whether the obstacle is located in the expected course, wherein the controller receives from the sensor the obstacle information as a group of points each having three dimensional location information, wherein the controller sets, to each point of the group of points, a weighting value according to a location in a height direction of each respective point of the group of points, and wherein the controller sets a grid as the grid in which the obstacle is positioned when the group of points is projected on the two dimensional polar coordinates and a total of the weighting values of the group of points included in the grid exceeds a threshold value.

* * * * *